US006668429B2

(12) United States Patent
Fujisawa et al.

(10) Patent No.: US 6,668,429 B2
(45) Date of Patent: Dec. 30, 2003

(54) DEEP-GROOVE FASTENER

(75) Inventors: Nobuo Fujisawa, Macon, GA (US); Craig Jay Graham, Eastman, GA (US); Wolfgang Eduardo Coronel, Macon, GA (US); Joel William Pfeil, Dry Branch, GA (US)

(73) Assignee: YKK Corporation of America, Marietta, GA (US)

( * ) Notice: Subject to any disclaimer, the term of this patent is extended or adjusted under 35 U.S.C. 154(b) by 0 days.

(21) Appl. No.: 10/139,162

(22) Filed: May 3, 2002

(65) Prior Publication Data

US 2003/0204939 A1 Nov. 6, 2003

(51) Int. Cl.[7] ..... A44B 21/00
(52) U.S. Cl. ..... 24/303; 297/452.6; 24/297
(58) Field of Search ..... 24/303, 66.1; 297/452.61, 297/452.59, 452.6, 218.1, 218.2; 428/99, 100, 119

(56) References Cited

U.S. PATENT DOCUMENTS

| | | | | | |
|---|---|---|---|---|---|
| 2,636,189 | A | * | 4/1953 | Feldman | 5/93.1 |
| 3,475,810 | A | | 11/1969 | Mates | |
| 3,604,067 | A | * | 9/1971 | Brown | 24/67 R |
| 3,794,378 | A | * | 2/1974 | Haslam et al. | 297/452.6 |
| 3,879,835 | A | * | 4/1975 | Brumlik | 29/412 |
| 4,109,887 | A | * | 8/1978 | Wakeland, Jr. | 5/678 |
| 4,364,607 | A | * | 12/1982 | Tamburini | 297/452.59 |
| 4,679,851 | A | | 7/1987 | Solie et al. | |
| 4,703,531 | A | * | 11/1987 | Bissett | 5/663 |
| 4,887,338 | A | | 12/1989 | Handler | |
| 5,005,242 | A | | 4/1991 | Kennedy et al. | |
| 5,101,539 | A | | 4/1992 | Kennedy et al. | |
| 5,171,395 | A | | 12/1992 | Gilcreast | |
| 5,259,905 | A | | 11/1993 | Gilcreast | |
| 5,396,687 | A | * | 3/1995 | Osterman | 24/449 |
| 5,499,859 | A | * | 3/1996 | Angell | 297/218.3 |
| 5,688,576 | A | * | 11/1997 | Ohno et al. | 428/100 |
| 5,725,928 | A | * | 3/1998 | Kenney et al. | 428/100 |
| 5,762,842 | A | * | 6/1998 | Burchi et al. | 264/46.4 |
| 5,795,640 | A | * | 8/1998 | Billarant | 428/100 |
| 5,827,546 | A | | 10/1998 | Burchi et al. | |
| 5,827,547 | A | | 10/1998 | Burchi et al. | |
| 5,882,073 | A | | 3/1999 | Burchi et al. | |
| 5,900,303 | A | * | 5/1999 | Billarant | 428/100 |
| 5,964,017 | A | * | 10/1999 | Roberts | 29/91.1 |
| 5,966,782 | A | * | 10/1999 | Ishihara et al. | 24/297 |
| 6,209,177 | B1 | | 4/2001 | Murasaki | |
| 6,405,413 | B2 | * | 6/2002 | Ichimaru et al. | 24/297 |
| 6,487,759 | B1 | * | 12/2002 | Akeno et al. | 24/589.1 |
| 6,596,371 | B1 | * | 7/2003 | Billarant et al. | 428/99 |

FOREIGN PATENT DOCUMENTS

| | | | | |
|---|---|---|---|---|
| DE | 4220685 | A1 * | 1/1994 | B60N/2/26 |

* cited by examiner

*Primary Examiner*—J. J. Swann
*Assistant Examiner*—Thomas Ho
(74) *Attorney, Agent, or Firm*—John A. Galbreath

(57) ABSTRACT

The invention is a deep-groove fastener which securely retains a seat cover within the groove of a deeply contoured seat bun. The fastener comprises an elongated body generally concave in cross section and having an interior cavity. A plurality of notched ridges are located on the surface of the interior cavity. The notched ridges serve as fastening elements for engaging loop or other material attached to the underside of a seat cover. Anchor elements are located on the exterior, non-cavity surface of the main body, to aid in anchoring the invention within a foam seat bun. The main body additionally comprises two flange-like sealing legs having a relatively flat bottom surface, to seal the sides of the invention against fouling during the seat bun molding process. Magnetically attractable particles are incorporated into the sealing legs, to hold the invention securely to a magnetized seat bun forming mold.

18 Claims, 8 Drawing Sheets

DEEP-GROOVE FASTENER

CROSS-REFERENCES TO RELATED APPLICATIONS

Not applicable.

BACKGROUND

1. Field of the Invention

This invention is in the area of fasteners which are molded into foam seat buns in order to engage a seat cover, specifically a deep-groove fastener which can securely retain a seat cover within the groove of a deeply contoured seat bun.

2. Description of the Related Art

Various methods for holding a seat cover within the groove of a deeply contoured foam seat bun have been disclosed in the prior art:

Pedestals which hold the fastener strip up into the foam bun during the molding process, are disclosed in U.S. Pat. Nos. 5,171,395 and 5,259,905, both to Gilcreast. These patents additionally employ a preformed foam wall which surrounds the pedestal just below the fastener strip to prevent fouling of the hooks or loops.

Plastic supports in the shape of a pointed ridge or "steeple", over which the hook or loop fastener strip rests, are temporarily mounted to a mold. The bun is thus formed with a deep groove having the desired shape, with the hook or loop fastener integrally molded into this groove. A mating pointed support, with a mating hook or loop fastener attached to its outer surface, is affixed to the seat cover. U.S. Pat. Nos. 5,005,242 and 5,101,539, both to Kennedy et al., exemplify this method.

In U.S. Pat. No. 5,641,552 to Tillner, a pull-in rod installed within the groove in the seat cushion pulls the seat cover into the groove and anchors it there. The pull-in rod is not molded into the seat cushion during the forming process, but rather is installed into the seat cushion after the cushion has been formed.

U.S. Pat. Nos. 5,762,842; 5,827,546; 5,827,547; and 5,882,073; all to Burchi et al., disclose a seat cover anchoring system wherein a piping-like strip attached to the seat cover snaps into a corresponding mating groove molded into the seat bun.

U.S. Pat. No. 4,679,851 to Solie et al. discloses seat cover anchoring means wherein a hook fastener strip is placed in the bottom of the groove in the seat cushion. The hook fastener strip mates with a strip of loop material on the underside of the seat cover.

Other prior art patents disclose various hook-and-loop attachment methods, not for use in attaching seat covers to foam seat buns. For example, U.S. Pat. No. 4,887,338 to Handler shows a hinged hook fastener device which wraps around an inserted loop-covered member, in order to hold the loop-covered member in place. The loop-covered member is part of a shelf or shelf support. U.S. Pat. No. 3,475,810 to Mates shows rigid members joined by hook-and-loop strips, wherein the strips are in shear relationship to each other.

All these prior art methods have significant disadvantages, however:

Methods that employ a hook fastener strip placed in the bottom of the seat bun groove often do not have enough peel strength to adequately retain the seat cover in the groove. And if a wide enough area for hook-and-loop mating is provided at the bottom of the seat bun groove, then the groove cannot be very narrow—and a narrow groove in the seat bun is desirable in most situations.

Methods which use a steeple-shaped support, over which a hook or loop fastener strip is draped prior to molding the seat bun, involve multiple parts and are thus needlessly complex, difficult to execute, and costly. Adapting existing molds to use these methods is also difficult and costly.

Methods that use other seat cover anchoring elements, such as the piping-like strip and mating groove of Burchi et al., are unsatisfactory because they require a high degree of mating precision. If the mating elements are not placed precisely on the foam seat bun and the seat cover, the seat cover will fit too loosely or too tightly.

Thus it can be seen that a deep-groove fastener which is very simple in design and construction, yet is capable of producing a high-strength connection between the seat cover and the foam seat bun groove, would be a significant advantage over the prior art.

Accordingly, several objects and advantages of the invention are:

It is simple in design and construction, and can be easily manufactured in just one piece at low cost.

It is easy to use during the foam seat bun molding process, and does not require precise positioning and alignment.

It yields a high-strength connection between the seat cover and the groove in a deeply contoured foam seat bun.

Further objects and advantages of the invention will become apparent from a consideration of the drawings and ensuing description.

SUMMARY

The invention is a deep-groove fastener which is in-molded into a foam seat bun, and which securely retains a seat cover within a deep contour groove of that seat bun.

DETAILED DESCRIPTION OF THE INVENTION

Figure 1:
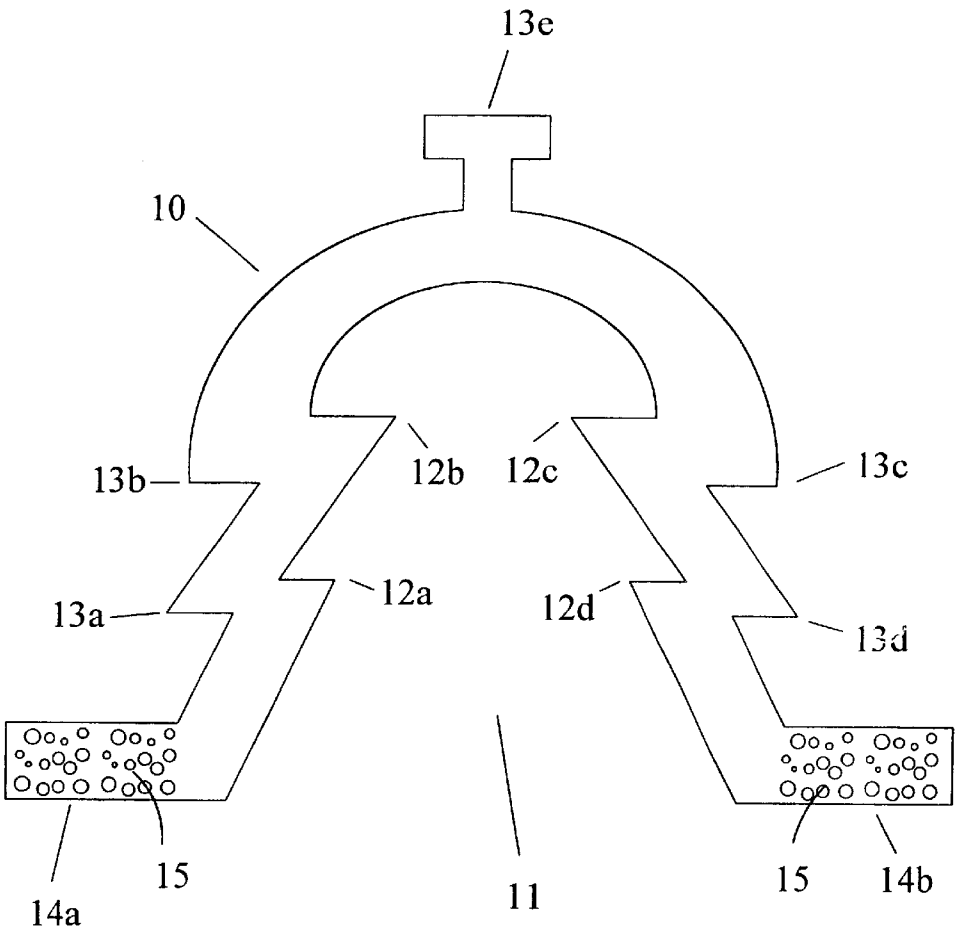
FIG. 1 is a cutaway end view of the fastener, showing the concave nature of the main body, the fastening elements lining the inner surface, and the magnetically attractable particulate matter incorporated into the leg areas of the fastener.

The following provides a list of the reference characters used in the drawings:

| | |
|---|---|
| 10. | Main body |
| 11. | Interior cavity |
| 12a, b, c, & d. | Notched ridges |
| 13a, b, c, d, & e. | Anchor elements |
| 14a & b. | Legs |
| 15. | Magnetically attractable particles |
| 16a, b, c, & d. | Arcuate notched ridges |
| 17. | Forming mold |
| 18. | Pedestal |
| 19. | Foam seat bun |
| 20. | Seat cover |
| 21. | Loop material |
| 22. | Extruder body |
| 23. | Notches |
| 24. | Reciprocating gate |
| 25. | Extruder opening |

Figure 2:
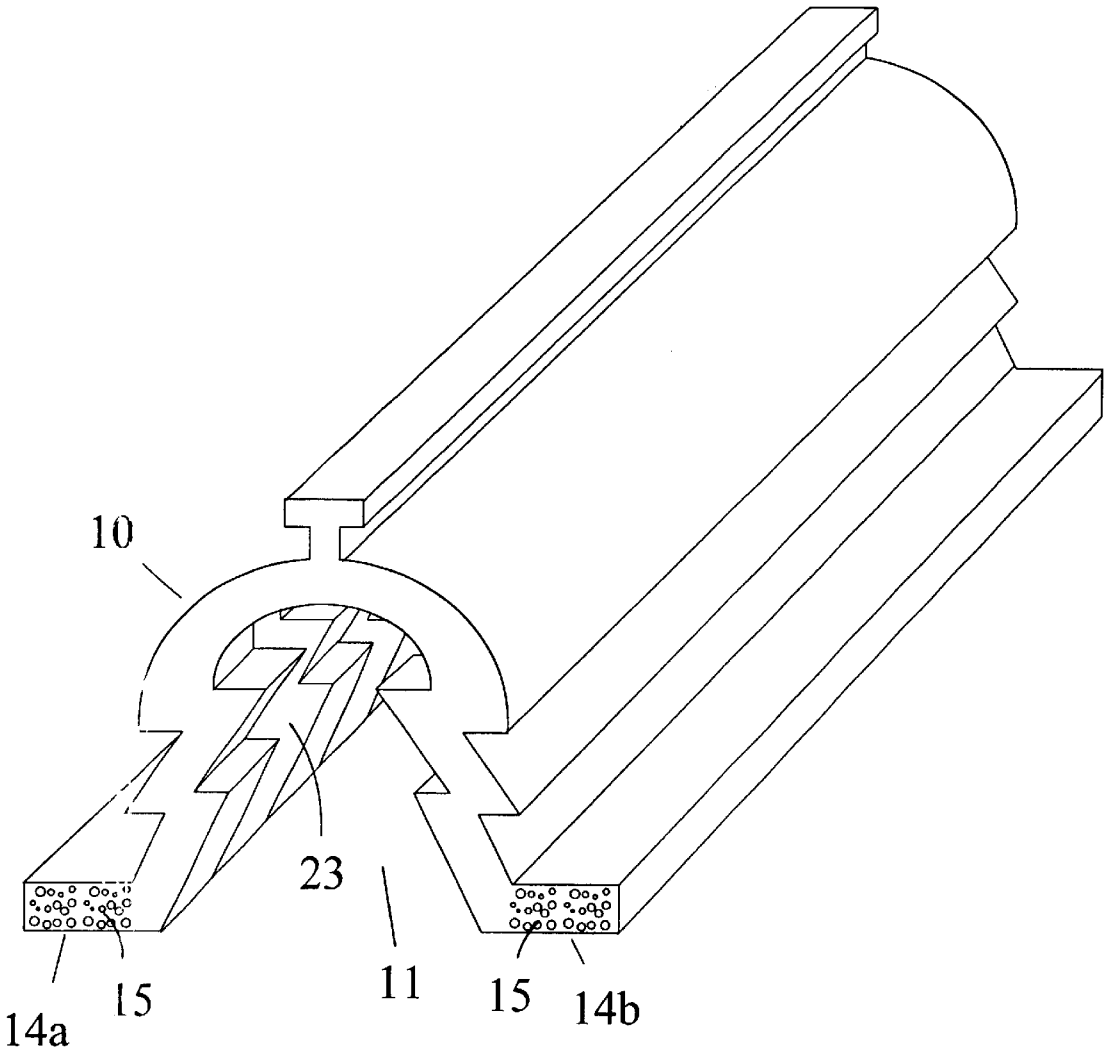
FIG. 2 is a perspective view, illustrating the elongated main body and the leg areas which serve to both secure the fastener to the forming mold and seal the interior of the fastener against fouling during the forming process.

As shown in FIGS. 1 and 2, the invention comprises an elongated body 10, generally concave in cross section and having an interior cavity 11. A plurality of notched ridges 12*a,b,c*, &*d*, wedge-like in cross-section, are located on the surface of interior cavity 11. Notched ridges 12*a,b,c*, &*d* have a plurality of spaced notches 23, and serve as fastening elements for engaging loop or other material attached to the underside of a seat cover. Anchor elements 13*a,b,c,d*, &*e* are located on the exterior, non-cavity surface of main body 10, to aid in anchoring the invention within a foam seat bun after the seat bun molding process is complete.

Main body 10 additionally comprises two opposing legs 14*a*&*b*. Legs 14*a*&*b* are flange-like in nature, and have a relatively flat bottom surface in order to seal the sides of the invention against fouling during the seat bun molding process. Magnetically attractable particles 15 are additionally incorporated into legs 14*a*, &*b*, in order to hold the invention securely to a magnetized seat bun forming mold.

Figure 3:
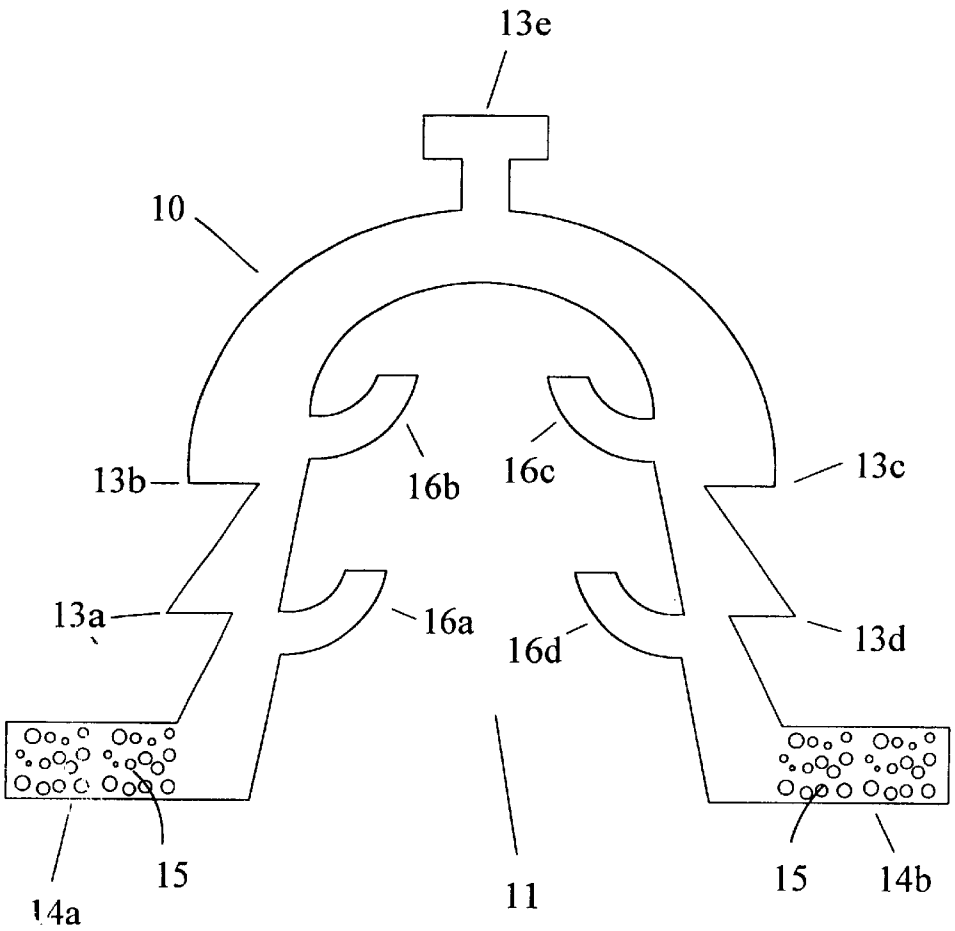
FIG. 3 is a cutaway end view of an alternative embodiment with differently-shaped fastening elements lining the inner surface of the deep-groove fastener.

FIG. 3 is a cutaway end view of an alternative embodiment with differently-shaped, arcuate notched ridges 16*a,b,c*, &*d* lining the inner surface of the deep-groove fastener. In this embodiment, arcuate notched ridges 16*a,b,c*, &*d* having a generally curved cross-section are located on the surface of interior cavity 11. Other parts are the same as in the main embodiment.

Figure 4:
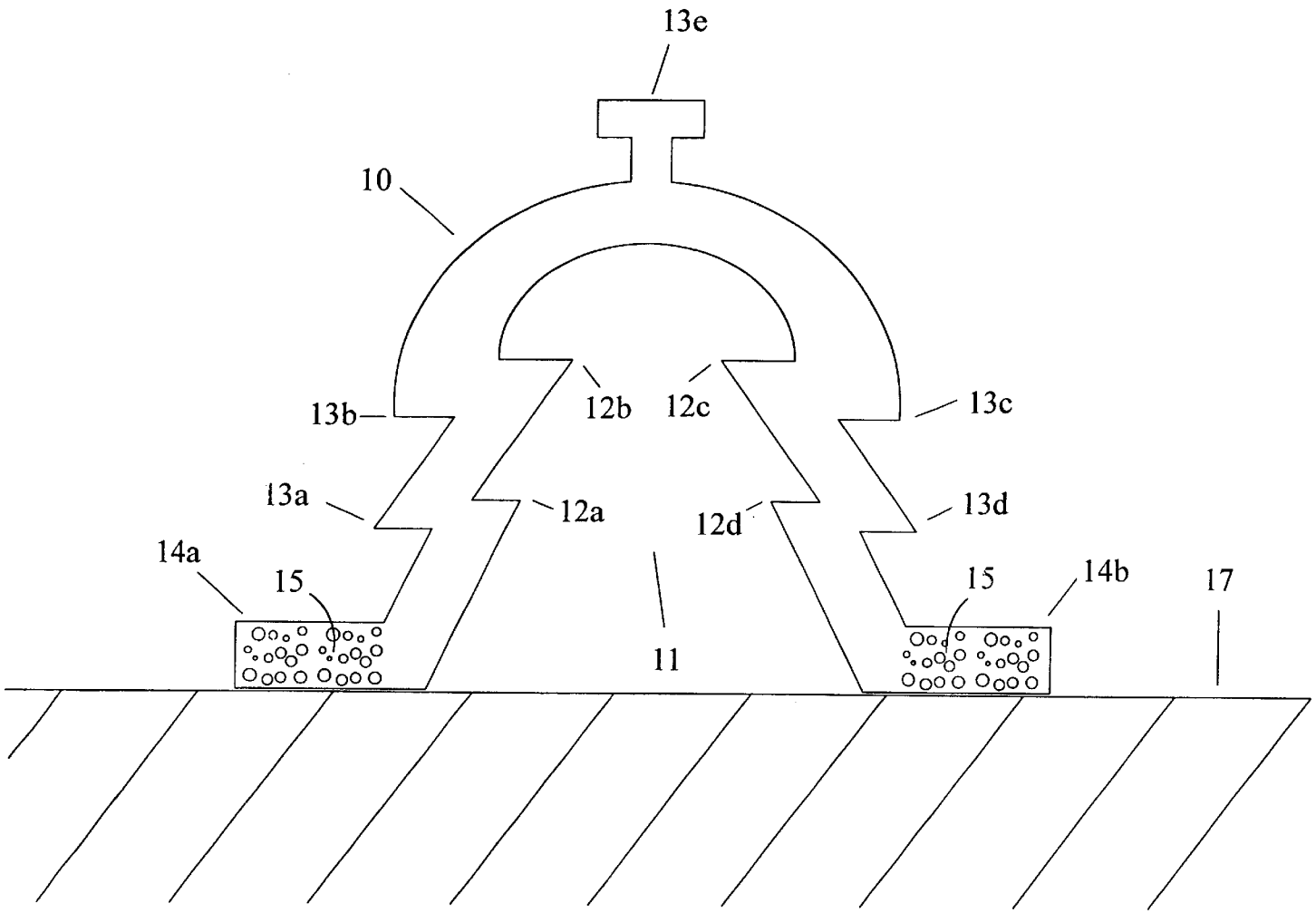
FIG. 4 is a cutaway end view of the fastener in a forming mold.
Figure 5:
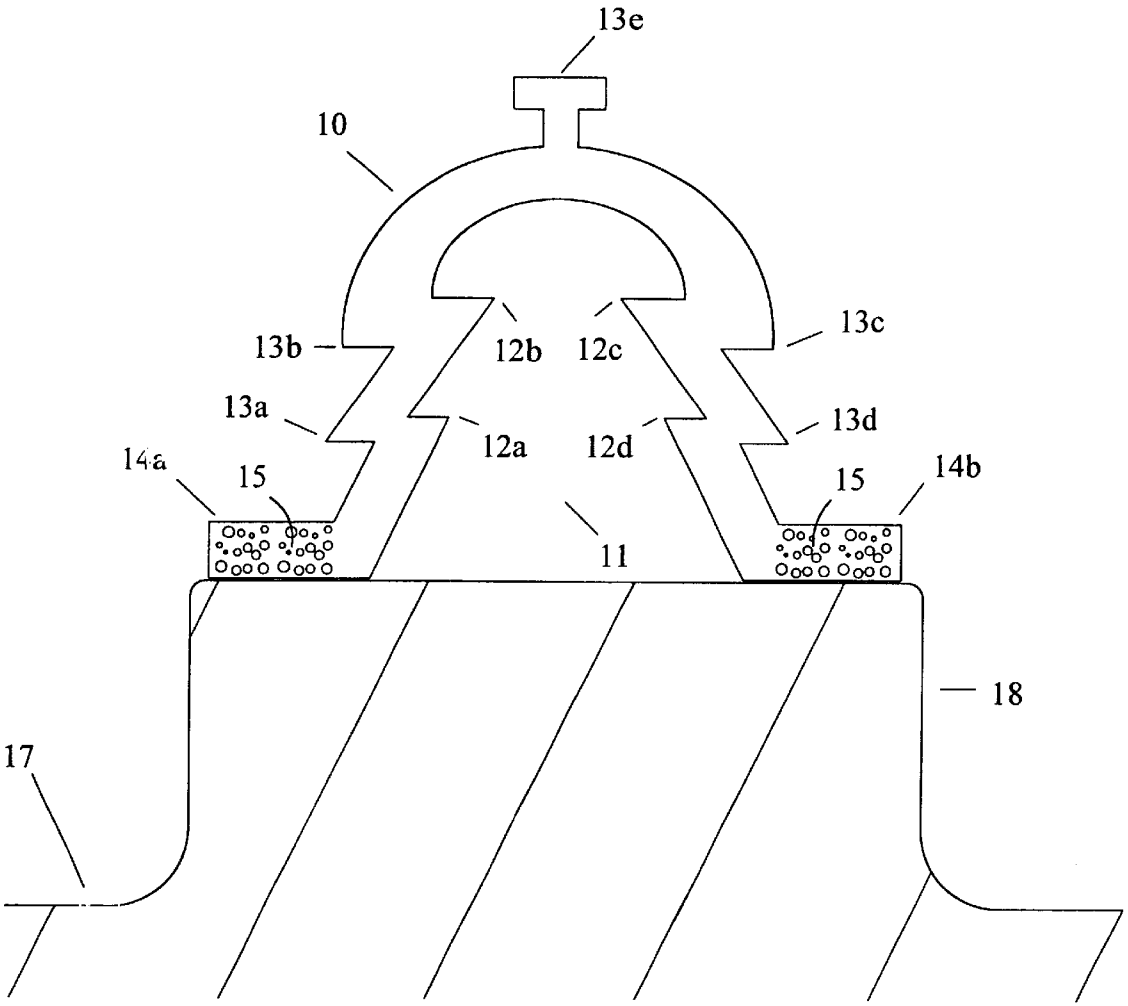
FIG. 5 is another cutaway end view of the fastener in a forming mold, said forming mold having a pedestal on which the fastener is placed.

FIGS. 4 and 5 are cutaway views illustrating the placement of the invention in a foam seat bun forming mold 17. In FIG. 4, the invention is placed directly on the flat portion of forming mold 17, and the shape of the invention itself forms the entirety of the groove in the resultant foam seat bun. In FIG. 5, the invention is placed on a pedestal 18 within forming mold 17, such that pedestal 18 and the shape of the invention combine to form the groove in the resultant seat bun.

Figure 6:
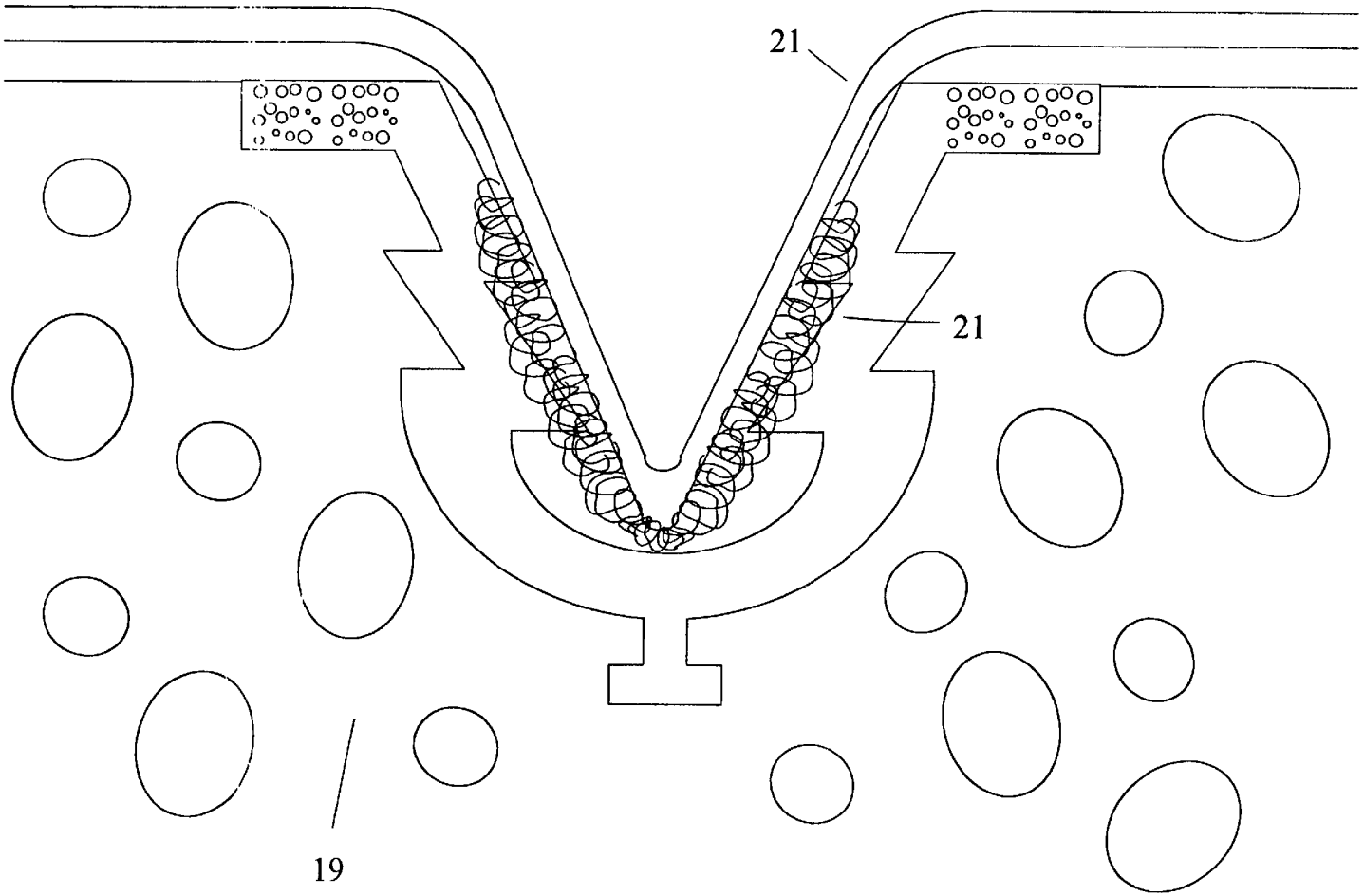
FIG. 6 is a perspective view of the fastener molded into the grooved area of a foam seat bun, illustrating the ability of the fastener to lock a seat cover securely in place on a deeply contoured, grooved seat bun.

FIG. 6 illustrates the invention after it has been molded into a foam seat bun 19. A strip of loop material 21 is located on the underside of a seat cover 20. As seat cover 20 is pushed into the device, loop material 21 positively engages notched ridges 12*a,b,c*, &*d*.

Figure 7:
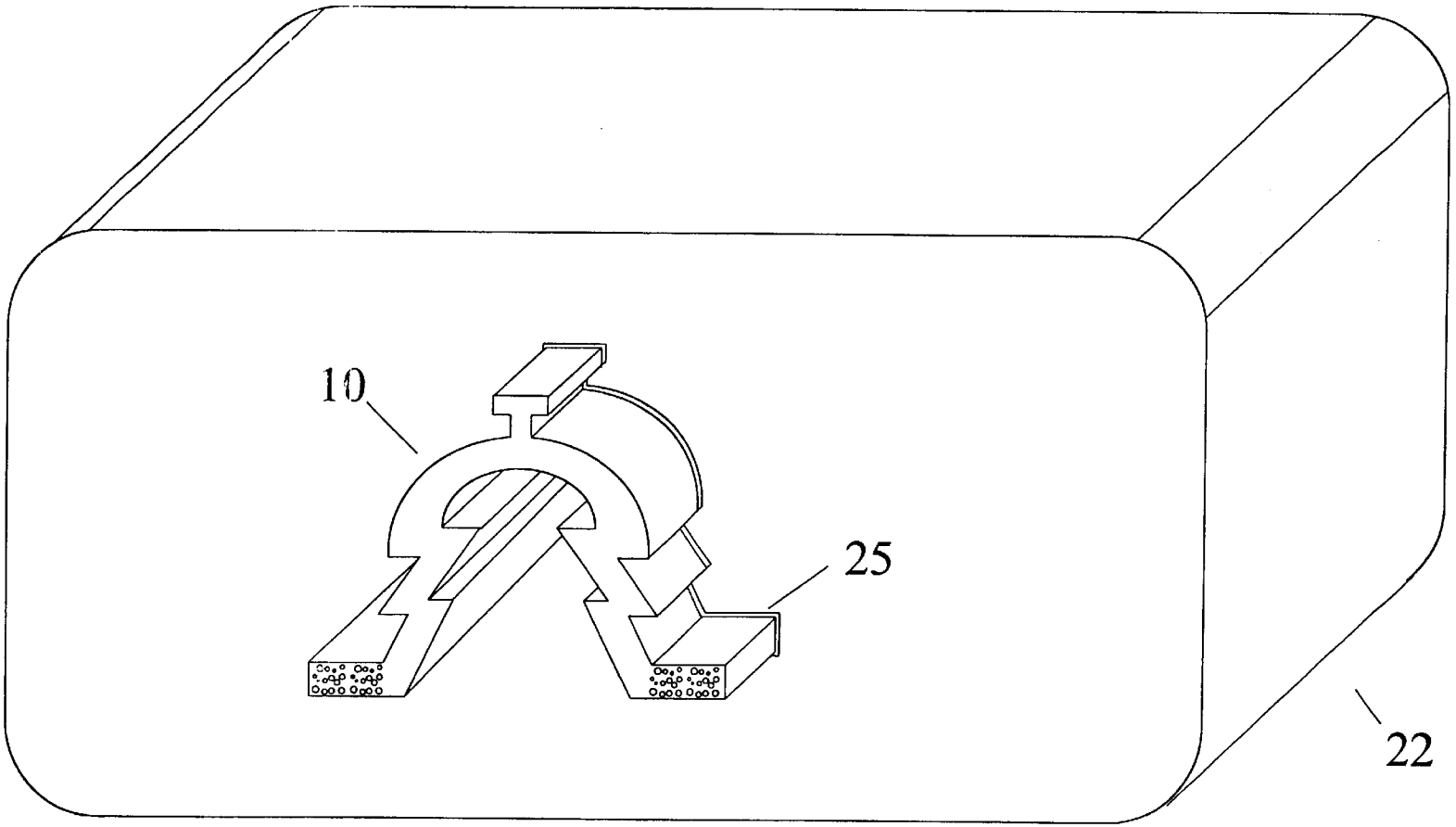
FIG. 7 illustrates the process of forming the fastener by extrusion from an extruder body.

Turning now to processes for manufacturing the invention, FIG. 7 illustrates an extrusion process wherein the invention is extruded from an extruder body 22 through extruder opening 25. The extrusion process forms main body 10, interior cavity 11, notched ridges 12*a,b,c*, &*d* (however, the ridges are not yet notched), anchor elements 13*a,b,c,d*, &*e*, and legs 14*a*&*b* all in one manufacturing step. Magnetically attractable particles 15 are incorporated into legs 14*a*&*b* during extrusion, via a co-extrusion process wherein resin containing magnetically attractable particles 15 is introduced discretely into legs 14*a*&*b* through a separate extruding nozzle and/or a separate channel within extruder body 22.

Figure 8:
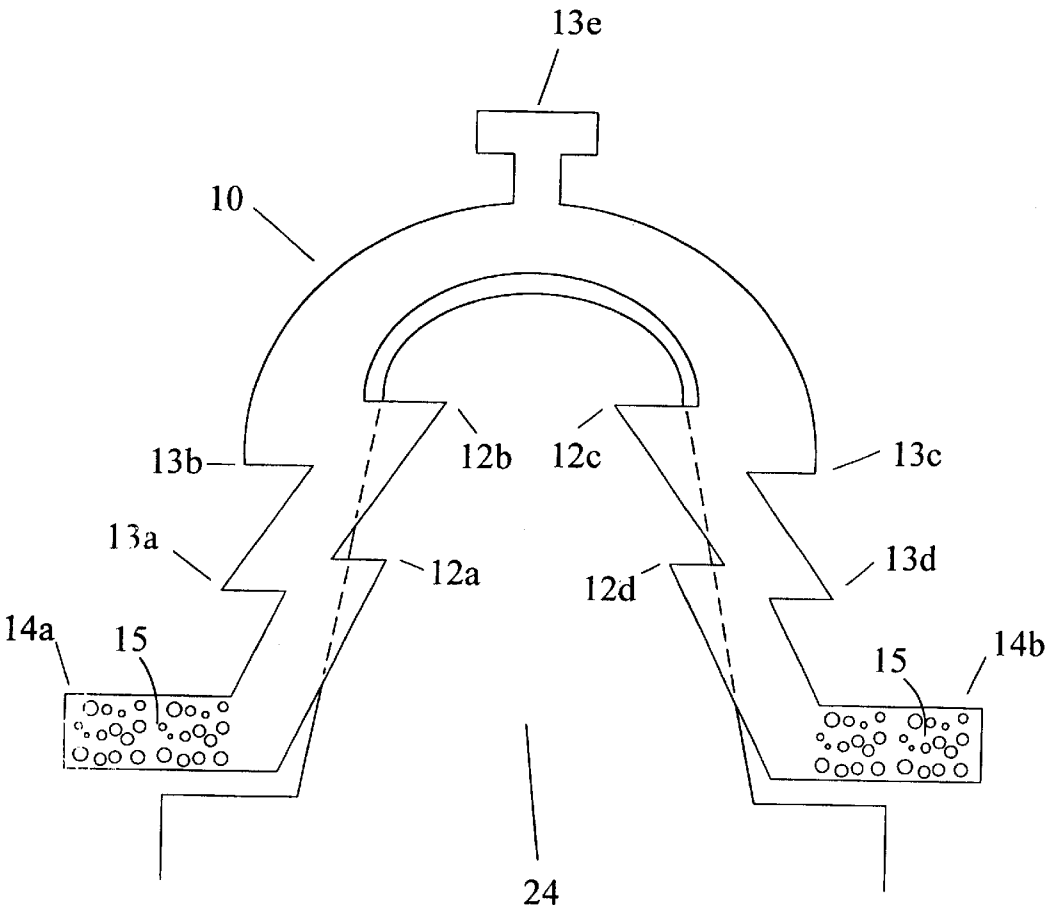
FIG. 8 illustrates the use of a reciprocating gate, located at the extruder opening, to form notches in the extruded ridges on the interior of the fastener.

Notches 23 in notched ridges 12*a,b,c*, &*d* can be formed using various methods, including via a subsequent cutting operation which carves out notches 23 following the primary extrusion process. Another method for forming notches 23 is shown in FIG. 8, wherein a reciprocating gate 24 located at extruder opening 25 alternatively moves in and out of interior cavity 11 as main body 10 emerges from extruder opening 25, thus forming notches 23 in notched ridges 12*a,b,c*, &*d*. This reciprocating gate method is further described in U.S. Pat. No. 6,209,177 to Murasaki, incorporated herein by reference.

Conclusions, Ramifications, and Scope:

Thus the reader will see that this invention provides a very effective way of securely retaining a seat cover within a deep contour groove of a foam seat bun.

While the above descriptions contain many specificities, these shall not be construed as limitations on the scope of the invention, but rather as exemplifications of embodiments thereof. Many other variations are possible. Examples of just a few of the possible variations follow:

The main body can have a different shape—for example, a flatter or sharper curve—in order to form differently-shaped grooves within the foam seat bun. Indeed, the main body does not have to be curved at all, but instead can be of a rectangular shape wherein the bottom of the interior cavity is "squared off" in relation to the interior cavity walls. Alternatively, the main body can be V-shaped, wherein the bottom of the interior cavity forms the point of the "V". The main body can be different heights, and different widths, in order to form differently-shaped grooves within the foam seat bun.

Magnetic holding means can be used that are different than the magnetically attractable particles; as just a few examples, magnetically attractable strips or wires attached to or imbedded into the leg portions of the main body. The magnetically attractable particles shown can also be incorporated into different areas of the main body.

Additional sealing means can be used to further seal the interface between the invention and the surface of the foam bun forming mold, thus further preventing fouling of the interior fastening elements during the seat bun molding process. Various means can also be employed to seal the ends of the invention against fouling. As just two examples, the ends of the main body can be crimped together either mechanically, by heat, or sonic welding; alternatively, covers can be placed over the ends of the main body to accomplish the same result.

The anchor elements can be located differently on the exterior (non-cavity) surface of the main body, can be differently-shaped, or can be eliminated.

The number of ridges can be different, and the ridges can be located differently on the surface of the interior cavity. As just one example, additional ridges can be located at the bottom of the interior cavity. The ridges can be made to be of different heights and shapes, simply by varying the shape of the extruder opening. The ridges can also be used without the notches shown in the various embodiments.

The number of notches on each ridge, per unit of ridge length, can be different than that shown in the drawings—resulting, of course, in different fastening element "density"

along the lengthwise dimension of the fastener. When using the reciprocal gate method of forming the notches, the reciprocating rate of the gate can be varied to yield various fastening element densities.

Even though the extrusion process illustrated herein can produce the invention in one piece, that is not required. The invention can instead be comprised of components separately manufactured and then assembled together.

Accordingly, the scope of the invention should be determined not by the embodiments illustrated, but by the appended claims and their legal equivalents.

What is claimed is:

1. A seat cushion fastener, comprising:

(a) a single elongated main body having an exterior surface, said elongated main body being of a substantially concave shape defining an interior cavity, and (b) a plurality of fastening elements located on a surface of said interior cavity, and (c) said elongated main body having two legs located on opposing sides at the mouth of said interior cavity, and (d) means for releasably securing said fastener to a seat cushion forming mold, whereby said seat cushion can be secured to an object.

2. The fastener of claim 1, wherein said fastening elements comprise ridges extending along the length of said main body.

3. The fastener of claim 2, wherein said ridges have spaced notches disposed along their length.

4. The fastener of claim 1, wherein at least one anchoring element, for use in securing said fastener within said seat cushion, is located on said exterior surface of said main body.

5. The fastener of claim 1, wherein said releasably securing means comprise magnetically attractable particles incorporated into said fastener.

6. The fastener of claim 5, wherein said magnetically attractable particles are incorporated into said sealing legs of said fastener.

7. A seat cushion fastener, comprising:

(a) a single elongated main body having an exterior surface, said elongated main body being of an overall shape so as to define an interior cavity, the sides of said interior cavity being free of through-holes, and (b) a plurality of fastening ridges located on a surface of said interior cavity and extending along the length of said main body, (c) said elongated main body having two legs located on opposing sides at the mouth of said interior cavity, whereby said seat cushion can be fastened to an object.

8. The fastener of claim 7, wherein said fastening ridges have spaced notches disposed along their length.

9. The fastener of claim 7, wherein at least one anchoring element, for use in securing said fastener within a seat cushion, is located on said exterior surface of said main body.

10. The fastener of claim 7, wherein said fastener additionally comprises means for releasably securing said fastener to a seat cushion forming mold.

11. The fastener of claim 10, wherein said releasably securing means comprise magnetically attractable particles incorporated into said fastener.

12. The fastener of claim 11, wherein said magnetically attractable particles are incorporated into two sealing legs of said fastener.

13. A seat cushion fastener, comprising:

(a) a main body having an exterior surface, said elongated main body being of a substantially concave shape defining an interior cavity, the sides of said interior cavity being free of through-holes, and (b) a plurality of ridges located on a surface of said interior cavity, said ridges being notched along their lengthwise dimension, whereby said notched ridges on said interior cavity can be fastened to corresponding engaging elements on an object.

14. The fastener of claim 13, wherein said fastener additionally comprises two sealing legs located on opposing sides of said interior cavity.

15. The fastener of claim 13, wherein at least one anchoring element, for use in securing said fastener within a seat cushion, is located on said exterior surface of said main body.

16. The fastener of claim 13, wherein said fastener additionally comprises means for releasably securing said fastener to a seat cushion forming mold.

17. The fastener of claim 16, wherein said releasably securing means comprise magnetically attractable particles incorporated into said fastener.

18. The fastener of claim 17, wherein said magnetically attractable particles are incorporated into two sealing legs of said fastener.

* * * * *